United States Patent [19]

Ouig

[11] Patent Number: 5,073,252

[45] Date of Patent: Dec. 17, 1991

[54] PNEUMATIC SIZE SEPARATOR FOR NICKLE-CONTAINING PARTICLES

[75] Inventor: Gary F. Ouig, Lively, Canada

[73] Assignee: INCO Limited, Toronto, Canada

[21] Appl. No.: 526,177

[22] Filed: May 21, 1990

[30] Foreign Application Priority Data

May 23, 1989 [CA] Canada ..... 600360

[51] Int. Cl.[5] ..... B07B 4/00

[52] U.S. Cl. ..... 209/139.1; 209/143; 209/149

[58] Field of Search ..... 209/138, 139.1, 142, 209/143, 149, 639, 644, 133, 136, 137

[56] References Cited

U.S. PATENT DOCUMENTS

| | | | |
|---|---|---|---|
| 409,258 | 8/1989 | Ward . | |
| 2,203,821 | 6/1940 | Hinchman | 209/139.1 X |
| 2,204,032 | 6/1940 | Whittock | 209/139.1 |
| 3,042,498 | 7/1962 | Norman | 23/277 |
| 3,104,155 | 9/1963 | Lewis | 209/138 X |
| 3,311,234 | 3/1967 | Rumpf et al. | 209/137 |
| 3,312,341 | 4/1967 | Weinecke et al. | 209/2 |
| 3,907,670 | 9/1975 | Fernandes | 209/139.1 X |
| 4,441,995 | 4/1984 | Dudley | 209/137 |
| 4,700,636 | 10/1987 | Vogt et al. | 209/139.1 X |
| 4,810,370 | 3/1989 | Taskinen | 209/155 |
| 4,908,123 | 3/1990 | Miers | 209/139.1 X |
| 4,908,124 | 3/1990 | Goldbach et al. | 209/133 X |

FOREIGN PATENT DOCUMENTS

| | | |
|---|---|---|
| 1270495 | 4/1972 | United Kingdom . |
| 1507751 | 4/1978 | United Kingdom . |
| 2191118 | 12/1987 | United Kingdom . |
| 2193449 | 2/1988 | United Kingdom . |

*Primary Examiner*—Donald T. Hajec
*Assistant Examiner*—Joseph A. Kaufman
*Attorney, Agent, or Firm*—Francis J. Mulligan, Jr.; Blake T. Bierderman

[57] ABSTRACT

A device for separating particles by size having a substantially vertical conduit. The vertical conduit has an open upper end and a closed lower end. A gas supply inlet is located between the upper end and the lower end to supply an upward flow of gas through the vertical conduit to the open end. The downwardly sloped conduit supplies a stream of various size particles to the vertical conduit. The downwardly sloped conduit has a lower side connected to the open end of the vertical conduit to form an opening in the lower side of the sloped pipe. The opening has an upstream edge and a downstream edge. The downwardly sloped conduit has a particle dam extending partially into the downwardly sloped conduit from the downstream edge of the opening. Coarser particles fall against the upward flow of gas falling down the vertical conduit to the closed end for collection. Finer particles are being lifted over the particle dam by the upward flow of gas and transported down the downwardly sloped conduit.

11 Claims, 1 Drawing Sheet

PNEUMATIC SIZE SEPARATOR FOR NICKLE-CONTAINING PARTICLES

This invention relates to a device for classifying particles. More particularly, it relates to the pneumatic separation of particles by size.

BACKGROUND OF THE ART AND PROBLEM

Classification or separation of particles by size is an important commercial operation in several industries. In classification or separation, a stream of mixed size particles is divided into a stream of relatively coarse particles and a stream of relatively fine particles. Several methods have been developed to separate particles including: dry-screening devices, wet-screening devices, hydraulic-settling classifiers, hydraulic-cyclone classifiers, pneumatic-settling classifiers and pneumatic-rotary vane classifiers. The particular type of classifier utilized in a specific industrial application depends upon the size distribution of the particles, shape of the particles, weight of the particles, volume of the particles to be processed and other factors particular to the particle to be separated.

Dry screening consists of simply passing particles over a screen having a known number of openings per linear unit or per unit area and dividing the particles into particles that passed through the screen and particles that did not pass through the screen. Wet screening adds water to the particles to improve the passing rate of particles through the screen. Pneumatic and hydraulic classification operates by balancing the forces of gravity with the forces of pneumatic or hydraulic drag. Coarse particles generally have a higher mass to surface area ratio then fine particles. This property is utilized in pneumatic and hydraulic separation to classify mixed size particles. The mixed size particles are placed in a moving fluid which transports the heavier coarse particles to one location and transports the lighter fine particles to a different location.

The type of commercial separator chosen to separate generally spherical particles of ferronickel from ferronickel dust produced from the decomposition of nickel carbonyl and iron carbonyl was a dry-screening device. Unfortunately, the dry-screening device did not adequately remove the dust or very fine particles of ferronickel. The resulting product was a less than desirable dusty product of ferronickel particles or powder. This dust interferes with the cleanliness of industrial applications of the ferronickel. Additionally, dry screening of the ferronickel particles is noisy, adding undesirable noise pollution to the work environment.

SUMMARY OF THE INVENTION

The present invention is a device for separating particles by size. The separating device has a substantially vertical conduit having an open upper end and a closed lower end. A gas supply inlet is located between the upper end and the lower end to supply an upward flow of gas through the vertical conduit to the open end. A downwardly sloped conduit supplies a stream of various size particles to the vertical conduit. The downwardly sloped conduit has a lower side connected to the open end of the vertical conduit to form an opening in the lower side of the sloped pipe. The opening has an upstream edge and a downstream edge. The downwardly sloped conduit has a particle dam extending partially into the downwardly sloped conduit from the downstream edge of the opening. Coarser particles fall against the upward flow of gas falling down the vertical conduit to the closed end for collection. Finer particles are lifted over the particle dam by the upward flow of gas and transported down the downwardly sloped conduit.

The particle dam has proven particularly effective when the particle dam extends vertically upward from the vertical conduit. The invention operates with mixed particles of various shapes and preferably separates mixed particles that are substantially spherical in shape. Ideally, the separator includes a valve which controls the gas flow rate for adjusting the size of particles which are transported down the vertical conduit. Most preferably, the vertical conduit is a cylindrical pipe and the length of the pipe between the gas supply inlet and the connection of the vertical conduit to the downwardly sloped conduit is at least 9 times the inner diameter of the pipe. This reduces the turbulence of the upward flow of gas below the connection.

Preferably, coarse particles are collected in a closed chamber at the lower end of the conduit. Additionally, the invention preferably includes pumping gas down the downwardly sloped conduit to enhance the downward movement of the fine sized particles. Ideally, coarser particles are distributed toward the lower side of the downwardly sloped conduit to improve separation. Optionally, a portion of the fine particles are recycled over the opening to remove coarse particles which may have been lifted over or have passed around the particles dam.

DESCRIPTION OF PREFERRED EMBODIMENT

Figure 1:
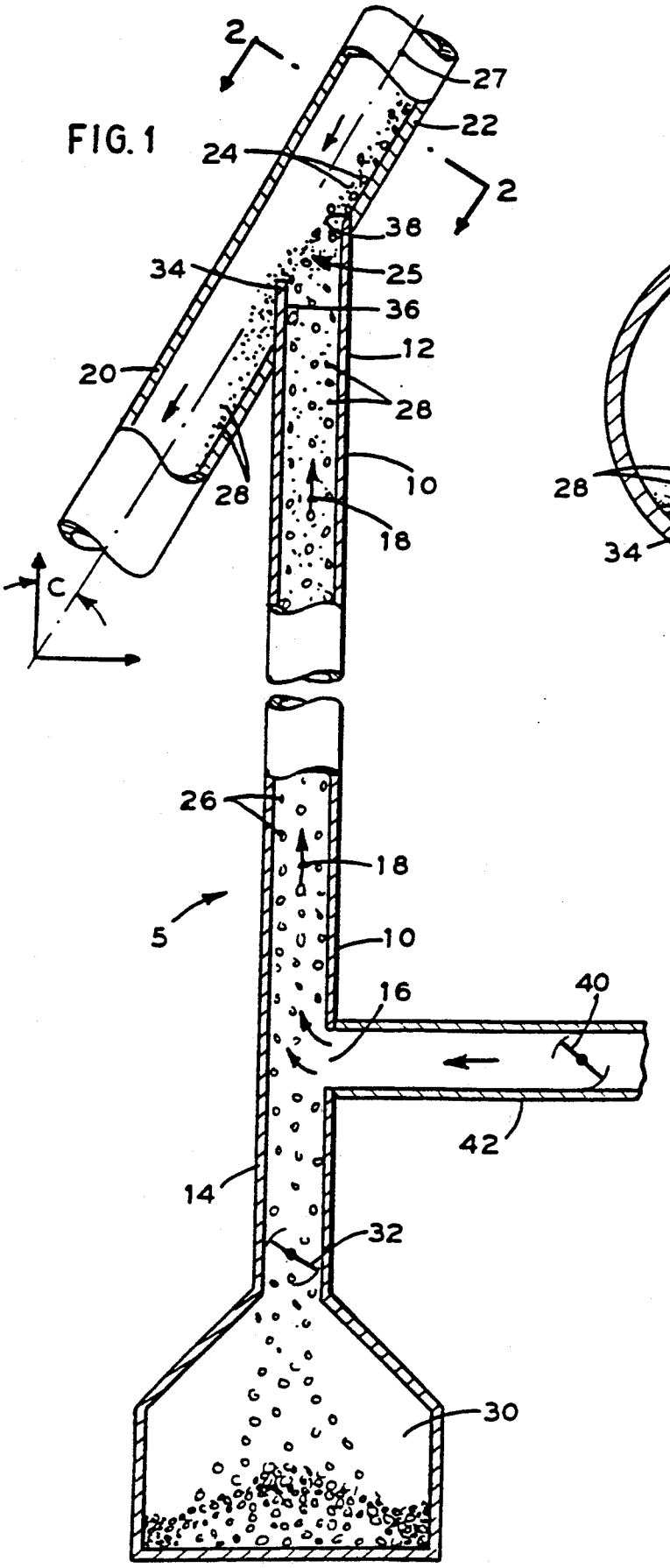
FIG. 1 is a cross-sectional view of an embodiment of the invention.

Referring to FIG. 1, the separator 5 includes a substantially vertical conduit or pipe 10 having an open upper end 12 and a closed lower end 14. A gas supply inlet 16 is located between the upper end 12 and the closed end 14. The gas supply inlet 16 provides a constant upward flow of gas as indicated by arrows 18 through the vertical conduit 10 to the open end 12.

A downwardly sloped conduit 20 has a lower side 22 openly connected to the open end 12 of the vertical conduit 10. The downwardly sloped conduit 20 supplies a flow of mixed size particles 24 to opening 25 above the open end 12 of the vertical conduit 10. The mixed size particles 24 above the opening 25 are then free to fall down the vertical conduit 10 against the upward flow of gas 18. The various or mixed size particles 24 include both coarse particles 26 and fine particles 28. For purposes of this specification, coarser particles are defined as a size range of particles which have enough weight to fall in an upward flow of gas and finer particle are defined as a range of particles which have a low enough weight to be lifted in an upward flow of gas. In the invention, coarser particles 26 fall down the vertical conduit 10 against the resistance of the upward flow of gas 18. The coarser particles 26 are then collected at the closed end 14. Finer particles 28 are lifted by the flow of gas 8 and are transported down conduit 20.

The closed end 14 may be closed by adding an enlarged sealed collection chamber 30. The closed end 14 alternatively may be sealed by connecting a sealed auger (not illustrated) to the closed end 14 to continuously remove the coarser particles 26. During operation of the separator the closed chamber 30 is periodically emptied to remove the accumulated coarser particles 26. The valve 32 is first closed, to force coarser powder to collect in the vertical conduit 10 above the closed valve 32. This accumulation above valve 32 prevents any interruption of the continuous operation of the particle separator. The chamber 30 is emptied without allowing any pressure drop in vertical conduit 10 which would allow finer particles 28 to drop into the closed end 14. The volume of the conduit 10 in the closed end 14 between the inlet 16 and valve 26 is preferably great enough to store the coarser particles 26 while the chamber 30 is emptied.

Angle c of the downwardly sloped conduit 20 is measured between an axis of symmetry 27 and a vertical reference line. Angle c preferably ranges between 10 and 70 degrees and most preferably between 15 and 45 degrees. Various or mixed size particles 24 travel down conduit 20 to the opening 25. Ideally, the conduit 20 has sufficient length that during this downward travel the heavier and coarser particles 26 tend to shift and settle to become distributed toward the lower side 22 of conduit 24. Conversely, the lighter fine particles 28, tend to be lifted above the heavier coarser particles 26. This distribution, having coarser particles 26 located preferentially toward the lower side 22 and finer particles 28 preferentially located above the coarser particles facilitates separation or classification of the mixed particles 24. The partially ordered distribution facilitates the separation by requiring less rearrangement of particles 24 in the open end 12 of the vertical conduit 10.

Figure 2:
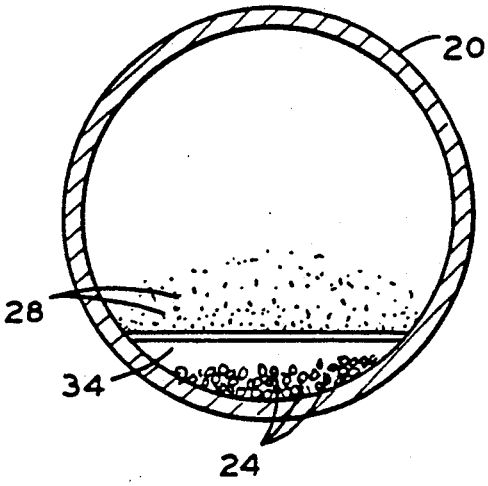
FIG. 2 is a view taken along plane 2—2 of the invention with the vertical conduit broken away.

Preferably, a particle dam 34 extends inwardly into the downwardly sloped conduit 20 from the downstream edge 36 of the opening 25. The upstream edge 38 remains flush with the opening 25 and conduit 20. The particle dam 34 prevents the mixed particles 24 from passing directly over opening 25. The mixed particles 24 are placed in a position in which they must be lifted by the upward flow of gas 18 to continue down the conduit 20. The particle dam 34 extends vertically upward from the vertical conduit 10 to force the finer particles 28 to be vertically lifted before continuing down the downwardly sloped conduit 20. Referring to FIGS. 1 and 2, the particle dam 34 extends across the lower side 22 of conduit 20. The height of the particle dam 34 is greatest at the lowermost point of the conduit 20 and tapers to zero at the side edges when measured from a transverse cross-section of conduit 20. The particle dam 34 is most preferably designed to intercept the coarser particles and a fraction of the finer particles, leaving the remainder of the finer particles to continue down conduit 20 essentially uninterrupted. These remaining finer particles are distributed well above the lower side 22 of the conduit 20 and are free to pass down the conduit without being lifted vertically upward over the particle dam 34 by the upward flow of gas 18. A portion of the finer particles 28 temporarily falls down the vertical conduit 10 where the particles are then lifted by the upward flow of gas 18 over particle dam 34. The heavier fine particles 28 tend to fall further down the vertical conduit 10 before being lifted by the upward flow of gas 18. An additional portion of the finer particles 28 may become vertically stabilized in the vertical conduit 10. The vertically stabilized particles do not tend to interfere significantly with the separation device. When rather large quantities of mixed particles are passed over the opening, a portion of the mixed particles may pass around the particle dam. The particles passing the opening may then be passed over the opening a second time to remove additional coarser particles.

Size of the coarse particles 20 collected is controlled by valve 40. Valve 40 is opened to increase the gas pressure and gas velocity first though conduit 42 and then the upward gas velocity 18 through vertical conduit 10 to increase the size of the particles required to fall down the vertical conduit. Increasing the size of particles required to fall to the closed end 14, decreases the range of coarser size particles 26 which are collected in the collection chamber 30. Similarly, to decrease the size of the coarse particles 26, the valve 40 is partially closed to decrease the upward velocity of gas 18 to allow finer particles to fall to the closed end 14. Decreasing the size of particles required to fall to the closed end 14, increases the range of coarser size particles 26 which are collected in the collection chamber 30. The simple adjustment of valve 40 provides the benefit of allowing the particle separator to classify coarser and finer particles into numerous different sizes.

Experimental particle separation was conducted with glass piping in order that the particles could be observed. The vertical pipe utilized a 1.27 cm (0.5 in) inner diameter pipe. The downwardly sloped pipe was connected to a 3.08 cm (2.0 in) inner diameter pipe. The downwardly sloped pipe was sloped 30 degrees from vertical, having an air pressure of 0.2 $kg/cm^2$ directed down the pipe. Although downward air pressure in the downwardly sloped pipe was used, test utilizing only gravity performed equally well. The downwardly sloped pipe had a minimum length of about 1 m, measured from the entrance of the mixed particles to the opening. This length was necessary to center the mixed particles on the lower side of the downwardly sloped pipe to force the maximum portion of the particles to be centered over the particle dam. The gas inlet was supplied with a 1.76 cm (0.75 in) inner diameter pipe. The particle dam extended vertically upward from the vertical pipe. The particle dam followed the curved downstream edge of the connection between the vertical pipe and the downwardly sloped pipe. The height of the particle dam ranged from 0.68 cm (0.25 in) at the midpoint of the connection and tapered to zero at the sides of the connection measured from a transverse cross-section of the downwardly sloped pipe. The downwardly sloped pipe was connected to a supply of powder decomposed from nickel carbonyl $Ni(CO_4)$ and iron carbonyl $Fe(CO)_5$ gas. The powder comprised mixed size spherical particles of ferronickel which ranged in size from about 40 um and to about 425 um. An upward flow of air at 25° C. was forced through the vertical pipe at about 3.2 m/s (10.5 ft/s).

Smoke tests were conducted to evaluate gas flow patterns. Through experimentation it was determined that the length of the vertical pipe between the inlet and the connection to the downwardly sloped pipe should be at least 9 times the inner diameter of the pipe. This ratio would vary with a change in inner diameter or inner wall smoothness of the pipe. The smoke tests demonstrated that the air was turbulent when making a 90 degree turn from the inlet to the vertical pipe. However, as the gas flowed up the vertical pipe it became less turbulent and more straight line in nature until it reached the opening where the turbulence again is increased due to the change in direction of the gas.

Table 1 below contains 4 different tests having different upward velocities of gas. As the velocity of the gas decreased, the rate of collection of the coarser particles increased. The particle distribution in the collection chamber was analyzed by sifting the particles through various standard sized screens. The distribution of the particles is contained below in Table 2. In Table 2, the + designation refers to particles being retained by a screen having the indicated size openings and the − designation refers to particles being passed through a screen having the indicated size openings. This separation has proven extremely effective in separating the metal powder. Clogging of the vertical pipe has not been a problem. In addition, this device is much quieter than dry screening and more effective at removing dust from the metal powder.

TABLE 1

| TEST GAS VELOCITY AND RECOVERY RATE | | | | |
|---|---|---|---|---|
| | TEST 1 | TEST 2 | TEST 3 | TEST 4 |
| GAS VELOCITY FT/SEC | 11.44 | 10.29 | 9.36 | 8.58 |
| GAS VELOCITY M/SEC | 3.77 | 3.38 | 3.07 | 2.81 |
| REMOVAL RATE TO COLLECTION CHAMBER (Grams per Minute) | 7.44 g/min | 12.31 g/min | 22.78 g/min | 38.26 g/min |

TABLE 2

| PARTICLE DISTRIBUTION IN COLLECTION CHAMBER | | | | | | | |
|---|---|---|---|---|---|---|---|
| SCREEN SIZE U.S. MESH | SCREEN SIZE OPENING PER LINEAR CENTIMETER | ORIGINAL BED | | TEST 1 | | TEST 2 | |
| | | WEIGHT (Grams) | WEIGHT PERCENT | WEIGHT (Grams) | WEIGHT PERCENT | WEIGHT (Grams) | WEIGHT PERCENT |
| +40 | +15.7 | 35.21 | 0.96 | 10.09 | 4.52 | 10.18 | 2.76 |
| −40 +60 | −15.7 +23.6 | 1071.27 | 29.51 | 189.58 | 84.9 | 290.89 | 78.74 |
| −60 +80 | −23.6 +31.5 | 912.79 | 25.14 | 21.30 | 9.54 | 62.86 | 17.02 |
| −80 +140 | −31.5 +55.1 | 1384.12 | 38.12 | 2.27 | 1.02 | 5.46 | 1.48 |
| −140 | −55.1 | 227.32 | 6.28 | 0.04 | 0.02 | 0.03 | 0.008 |
| +80 | +315 | 2019.37 | 55.62 | 220.97 | 98.97 | 363.93 | 98.38 |
| −80 | −315 | 1611.44 | 44.38 | 2.31 | 1.03 | 5.49 | 1.62 |

| SCREEN SIZE U.S. MESH | SCREEN SIZE OPENING PER LINEAR CENTIMETER | TEST 3 | | TEST 4 | |
|---|---|---|---|---|---|
| | | WEIGHT (Grams) | WEIGHT PERCENT | WEIGHT (Grams) | WEIGHT PERCENT |
| +40 | +15.7 | 13.69 | 2.0 | 18.3 | 1.56 |
| −40 +60 | −15.7 +23.6 | 467.86 | 68.45 | 647.25 | 55.09 |
| −60 +80 | −23.6 +31.5 | 164.08 | 24.0 | 338.0 | 28.77 |
| −80 +140 | −31.5 +55.1 | 37.83 | 5.53 | 144.0 | 12.26 |
| −140 | −55.1 | 0.05 | 0.007 | 0.27 | 0.02 |
| +80 | +315 | 645.63 | 94.46 | 1003.55 | 87.43 |
| −80 | −315 | 37.88 | 5.54 | 144.27 | 12.57 |

The invention may be adapted to separate ferronickel particles supplied directly from a ferronickel decomposer. Ferronickel particles in a downwardly sloped pipe travel to an opening where gas containing CO and $Ni(CO)_4$ at about 220° C. with a maximum pressure of about 0.84 kg/cm$^2$ (12 psi) meets the particles. The coarse ferronickel powder falls down vertical conduit in the nickel carbonyl containing gas. In the vertical conduit, the gas may decompose slightly onto the coarse particles. Decomposition of the gas is preferably avoided to avoid the plating separator pipes. The fine particles travel over the particle dam and are recycled to the decomposer for further growth and then are returned down the downwardly sloped pipe to the opening. When the recycled fine particles reach the critical coarse size, they fall down the vertical pipe for collection in a collection chamber. The length of the vertical pipe from the gas inlet to the collection chamber may optionally be increased to 10 m or more to transport coarse particles down to the collection chamber. The diameter of this portion of the vertical pipe may also be increased to help prevent clogging of the pipe. Also, it is recognized that the vertical pipe below the gas inlet may transport the coarser particles vertically and horizontally to a collection chamber at a desired location. In addition, recycling the finer particles and coarse particles which may have been lifted over or have passed around the dam over the opening a second time provides a second chance for coarser particles to fall down the vertical conduit.

Alternatively, the device may be used to separate a wide variety of materials such as grains, coal, silica sand and other materials readily classified by pneumatic means. The size of the conduits, height of the particles dam, slope of the downwardly sloped conduit and the velocity of the upward flow of gas may be adjusted to achieve the desired separation.

While in accordance with the provisions of the statute, there is illustrated and described herein specific embodiments of the invention. Those skilled in the art will understand that changes may be made in the form of the invention covered by the claims and the certain features of the invention may sometimes be used to advantage without a corresponding use of the other features.

The embodiments of the invention in which an exclusive property or privilege is claimed are defined as follows:

1. A device for separating nickel-containing particles by size comprising:

a substantially vertical cylindrical pipe having an open upper end, a closed lower end and an inner diameter, a gas supply inlet located between the open upper end and the closed lower end for supplying a near straight line unobstructed upward flow of gas through the vertical pipe from the gas supply inlet to the open upper end of the vertical pipe at a relatively constant rate, the gas supply inlet being a distance of at least 9 times the inner diameter of the vertical pipe from the open upper end of the vertical pipe for reducing turbulence and a downwardly sloped cylindrical pipe having a circular transverse cross section for supplying mixed size particles to the vertical pipe, the downwardly sloped pipe having a lower side connected to the open upper end of the vertical pipe to form an opening in the lower side of the downwardly sloped pipe, the opening having an upstream edge and a downstream edge, the downwardly sloped pipe being substantially linear between a location above the opening and a location below the opening and the circular transverse cross section of the downwardly sloped pipe being substantially uniform between the location above the opening and the location below the opening, and the upper surface of said downwardly sloped pipe opposite the vertical pipe being closed the downwardly sloped pipe having a particle dam extending partially into the downwardly sloped pipe from the downstream edge of the opening for allowing coarser particles to fall, against the upward flow of gas, down the vertical pipe to the closed end for collection and for lifting finer particles over the particle dam with the upward flow of gas for further transporting of the finer particles down the downwardly sloped pipe.

2. The device of claim 1 wherein the dam extends vertically upward from the vertical pipe.

3. The device of claim 1 wherein the mixed particles are substantially spherical in shape.

4. The device of claim 1 including a valve which controls the upward flow of gas in the vertical pipe for adjusting the size of particles falling down the vertical pipe.

5. A method of separating mixed size nickel-containing particles comprising:

providing a downwardly sloped conduit having a lower side and a circular transverse cross section, the lower side having an opening, the opening having a downstream edge and a particle dam extending upwardly partially into the downwardly sloped conduit the downwardly sloped conduit being substantially linear between a location above the opening and a location below the opening and the circular transverse cross section of the downwardly sloped conduit being substantially uniform between the location above the opening and the location below the opening, and the upper surface of said downwardly sloped conduit opposite the vertical conduit being closed, introducing an unobstructed upward flow of gas through a substantially vertical conduit from a gas supply inlet to the opening in the lower side of the conduit, the vertical conduit having an inner diameter, the upward flow of gas being supplied from the gas supply inlet spaced a distance of at least 9 times inner diameter of the vertical conduit from the opening to reduce turbulence, sending mixed size particles down the downwardly sloped conduit to produce a flow of mixed size particles distributed toward the lower side of the downwardly sloped conduit, passing the mixed size particles over the opening in the lower side of the downwardly sloped conduit, and separating the mixed size particles by having coarser particles fall down the vertical conduit against the stream of gas and finer particles being lifted over the particle dam by the upward flow of gas and transported down the downwardly sloped conduit.

6. The method of claim 5 additionally including the step of collecting the coarse particles in a closed chamber at a lower end of the vertical conduit.

7. The method of claim 5 additionally including the step of pumping gas down the downwardly sloped conduit.

8. The method of claim 5 additionally including the step of settling coarser particles toward the lower side of the downwardly sloped conduit before passing the mixed size particles over the opening.

9. The method of claim 5 additionally including the step of recycling a portion of the fine particles over the opening.

10. The method of claim 5 wherein the sending mixed size particles down the downwardly sloped conduit includes particles substantially spherical in shape.

11. The method of claim 5 wherein the providing of the downwardly sloped conduit includes the particle dam extending vertically upward from the vertical conduit.

* * * * *

UNITED STATES PATENT AND TRADEMARK OFFICE

CERTIFICATE OF CORRECTION

PATENT NO. : 5,073,252

DATED : DEC. 17, 1991

INVENTOR(S) : GARY F. QUIG

It is certified that error appears in the above-identified patent and that said Letters Patent is hereby corrected as shown below:

Cover page - [75] Inventor: Gary F. Ouig - last name should be:

[75] Inventor: Gary F. Quig

Under UNITED STATES PATENT [19] OUIG - should be

QUIG

Signed and Sealed this

Sixth Day of April, 1993

*Attest:*

STEPHEN G. KUNIN

*Attesting Officer*

*Acting Commissioner of Patents and Trademarks*